United States Patent [19]

Schmidt

[11] 4,351,223

[45] Sep. 28, 1982

[54] BURST FIRE COMPENSATOR

[75] Inventor: Edward M. Schmidt, Harford City, Md.

[73] Assignee: The United States of America as represented by the Secretary of the Army, Washington, D.C.

[21] Appl. No.: 177,031

[22] Filed: Aug. 11, 1980

[51] Int. Cl.[3] ..... F41F 17/12

[52] U.S. Cl. ..... 89/14 R; 89/41 SM

[58] Field of Search ..... 89/14 R, 14 C, 41 SM

[56] References Cited

U.S. PATENT DOCUMENTS 3,187,632 6/1965 Harvey ..... 89/14 R

*Primary Examiner*—Stephen C. Bentley

*Attorney, Agent, or Firm*—Nathan Edelberg; Robert P. Gibson; A. Victor Erkkila

[57] ABSTRACT

The compensator is attached to the muzzle of a gun to control the motion thereof during the firing of a burst, and thus modifying the dispersion pattern in a desired manner. The device includes an asymmetric channel forming an extension of approximately one half of the gun's barrel, mounted in such a way that exhausting propellant gases will rotate the device through and arc following the firing of each round of a burst.

5 Claims, 6 Drawing Figures

BURST FIRE COMPENSATOR

BACKGROUND OF THE INVENTION

This invention relates to means to control the firing pattern of automatic or semi-automatic weapons so that the within-the-burst dispersion is modified in a desired manner. Burst compensators are devices attached to the muzzle of a gun to control the motion of the weapon during the firing of a burst. One type of prior art compensator comprised fixed means to vent the exhausting propellant gases in an asymmetric manner so that a force, usually downward, was exerted on the muzzle upon firing. This downward force compensated for the tendency of most hand-held weapons to climb during firing. The present invention comprises a compensator intended to be attached to the muzzle of a gun and to provide compensation which varies from round-to-round within a burst, with the result that the firing pattern can be made to oscillate around a desired aim point. The device produces burst pattern control which is independent of the gunner's firing position or of the particular gunner. For example, it is effective whether the gunner is standing or prone, or right-handed or left-handed.

SUMMARY OF THE INVENTION

The burst fire compensator of this invention comprises a rotatable device attached to the gun muzzle. The device comprises a tubular collar section mounted for rotation around the barrel end or muzzle with an approximately half cylindrical forward projection forming an extension of the barrel. This tongue-like projection forms an asymmetric channel. This asymmetric channel results in asymmetric venting of the propellant gases which emerge after each round leaves the barrel. The reaction to the asymmetric venting causes movement of the weapon generally in the direction of the channel and movement of the round in the opposite direction. The asymmetric channel includes a plurality of lateral vent holes or nozzles through which some of the aforementioned propellant gases are vented to produce a reaction torque which rotates the compensator around the barrel through a predetermined arc after each round is fired, The result is that the compensation changes in a desired manner from round to round within a burst with the result that the burst pattern is changed in a desired manner.

It is thus an object of the invention to provide a burst fire compensator which varies the direction of compensation from round to round within a burst.

Another object of the invention is to provide a variable compensator which is operated automatically by propellant gases to change the compensation from round to round within a burst.

A still further object of the invention is to provide a simple mechanical device attachable to a gun muzzle which can improve the dispersion pattern of the gun.

These and other objects and advantages of the invention will become apparent from the following detailed description and drawings.

DETAILED DESCRIPTION OF A PREFERRED EMBODIMENT

The motion of a weapon during firing is determined by a variety of factors, including but not limited to, the magnitude and direction of the weapon's recoil, the position of the shooter, his anatomy and muscular strength, etc. Because of the number of human factors involved, a fixed compensator which works well for one individual may not be suitable for other individuals. Prior art compensators have been made manually adjustable to accommodate different shooters, but such compensators lacked flexibility since they had to be readjusted for different shooters or even for different positions of the same shooter.

The present invention comprises an automatic compensator which varies the compensation automatically during the firing of a burst. It has been found empirically that by varying the compensation in the manner of the present invention, the points of impact on a target can be made to oscillate closely around a desired aim point regardless of the identity of the shooter, or whether he is standing of prone while shooting. The device is also equally effective with right or left-handed shooters. The present compensator affects the motion of both the projectile and the weapon in different directions during a burst.

Figure 1:
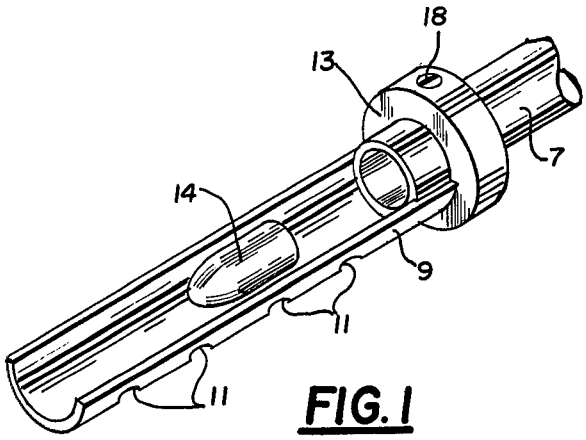
FIG. 1 is an isometric view of the novel compensator installed on a gun barrel.
Figure 3:
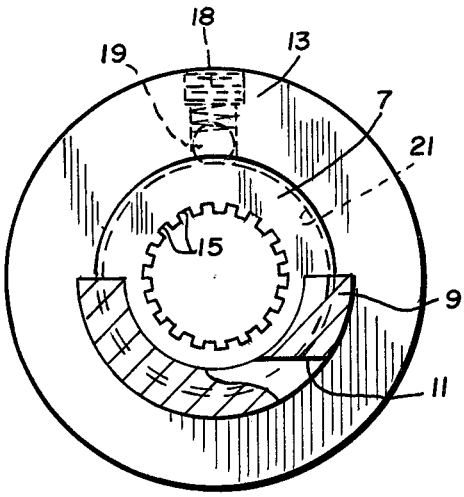
FIG. 3 is a front view thereof in section along line 3—3 of FIG. 2.

In the isometric view of FIG. 1, the compensator is shown attached to the muzzle of gun barrel 7. The compensator comprises a tubular collar 13 which fits snuggly around the barrel with the tongue-like projection 9 integrally attached thereto. The projection or asymmetric channel 9 comprises in effect an extension of one half of the barrel. The asymmetric channel is shown as half cylindrical, however it can be made somewhat greater or less than 180 degrees in angular extent. A projectile or round 14 is shown just after leaving the muzzle. Such apparatus causes an asymmetric venting of the propellant gas. Gas venting in the direction of the asymmetric channel is reduced, with most of the gases taking the path of least resistance and venting away from the asymmetric channel. The resultant reaction tends to push the muzzle in the direction of the asymmetric channel. Further, the high pressure between the projectile 14 and the asymmetric channel and the low pressure above the projectile due to the free venting in this area causes the projectile (or round) to move away from the asymmetric channel. The asymmetric channel has a plurality of lateral nozzles or holes 11 which extend from the interior thereof to one side thereof. These nozzles or holes are offset from alignment with the radial generators of the half cylinder which forms the asymmetric channel. A portion of the propellant gas is vented through these lateral holes. Since the lateral holes are directed sideways relative to the barrel and the compensator, and are offset from the center thereof, propellant gases venting therethrough will produce a reaction torque tending to rotate the entire compensator clockwise around the barrel, as viewed in FIG. 3. This reaction also affects the motion of the weapon since it tends to move the barrel in the direction opposite to the orientation of the vent holes 11 and this fact modifies slightly the main weapon movement discussed above caused by the presence of the asymmetric channel.

Figure 2:
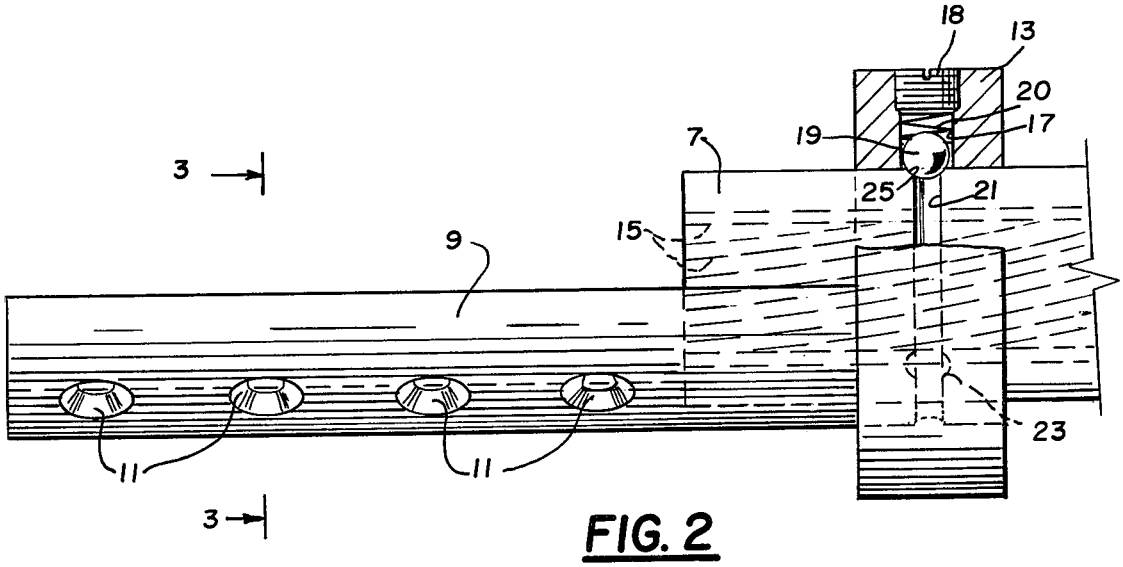
FIG. 2 is a side view of the novel compensator.

In the side view of FIG. 2, the barrel, collar, asymmetric channel and the vent holes all have the same reference numerals as in FIG. 1. The numeral 15 represents the barrel rifling. FIG. 2 shows details of the way in which the compensator is mounted on the barrel so that it rotates through a fixed arc after each round is fired. To this end the barrel 7 has a shallow groove 21 running around its periphery. The collar 13 has a radial hole 17 in it adapted to contain a spring-loaded ball 19 which engages the groove 21 to hold the collar asymmetric channel in place on the barrel, but permits it to rotate. The groove 21 may contain a number of detent holes 23 and 25, arranged so that the compensator will rotate through a certain arc after each firing. The detent holes are of hemispheric shape so that the ball 19 seats in them to form a detent. The spring 20 urges the ball toward the barrel. The set screw 18 holds the spring in place. The barrel may be provided with three equally spaced detent holes and the vent holes 11 may be designed in conjunction with the amount of propellant gas vented through them to rotate the compensator one third of a revolution or 120 degrees per round fired. With such an arrangement the compensator returns to its starting position every three rounds. Other arrangements are possible, for example, if it is desired that the compensator rotate 135 degrees per round, it would be necessary to provide eight detent holes around the groove 21, spaced 45 degrees apart. The torque generated by the venting gases passing through vent holes 11 and the strength of spring 20 would then all be chosen so that the compensator would skip or jump over two detent holes per round fired, and come to rest on the third hole, which would be 135 degrees from the first hole. With this arrangement the compensator would make three complete revolutions around the barrel before the starting position is reached, and it would assume eight different positions 135 degrees apart before repeating the cycle. Thus eight different compensation motions are possible for each round of an eight round burst. Such an arrangement of the burst compensator has empirically been found very effective for the intended purpose.

Figure 4:
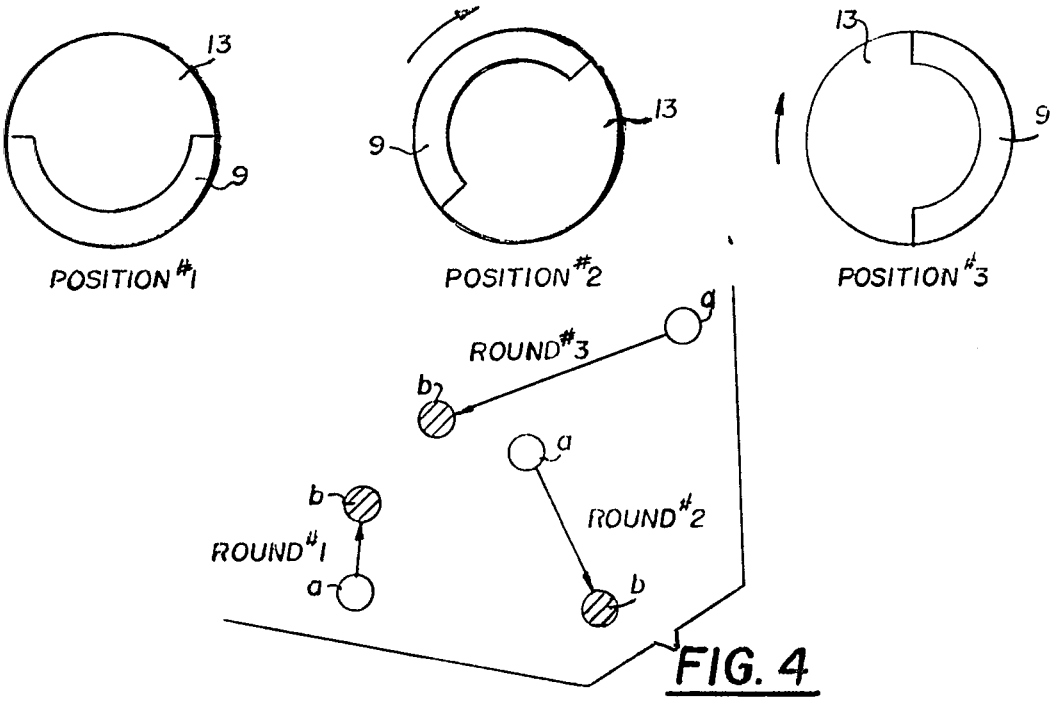
FIG. 4 illustrates how the compensator can alter the dispersion pattern of a burst.

FIG. 4 illustrates impact patterns of a hand-held weapon used by a left-handed gunner with and without the present novel compensator. The three unhatched impact holes labeled 'a' represent three rounds of a burst without the compensator installed. It can be seen that the weapon has moved upward and to the right during the burst. The three hatched impact holes 'b' show how the dispersion is reduced with the use of the compensator of FIGS. 1–3, arranged to index 135 degrees between bursts, with asymmetric channel 9 initially in Position 1 as shown in FIG. 4. The asymmetric venting, as explained above, has caused Round #1 to move upward, while simultaneously moving the weapon muzzle downward so that Round #2 impacts below its uncompensated position and slightly to the right due to the fact that in position 2 Round #2 will be moved in a direction opposite to the position of the asymmetric channel 9. Similarly, the compensator in Position 3 causes Round #3 to impact at the point shown, very close to Round #1.

Figure 5:
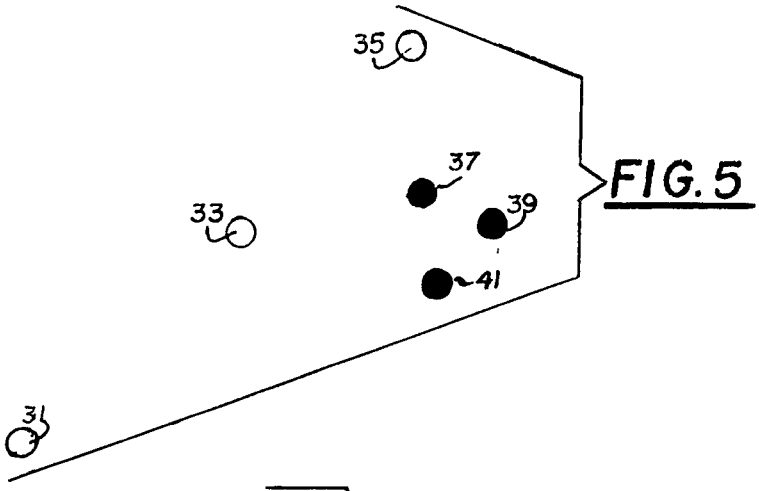
FIGS. 5 and 6 are further examples of the action of the novel compensator when used by left and right-handed shooters, respectively.
Figure 6:
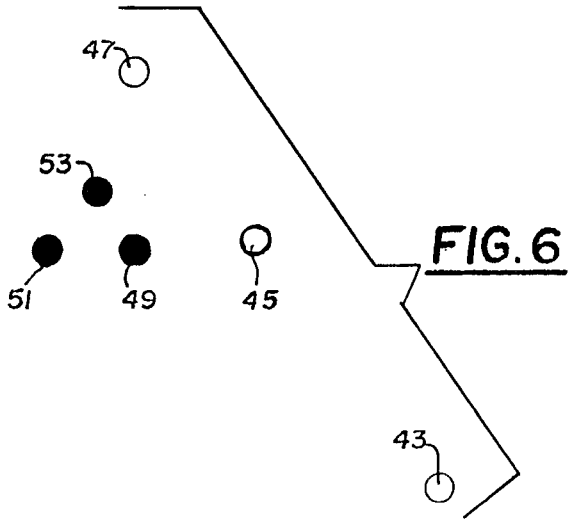

FIGS. 5 and 6 show actual patterns of the M-16 rifle with and without the present compensator, for left and right-handed shooters, respectively. In FIG. 5, the symbols 31, 33, and 35 represent a three round burst pattern without the compensator and the symbols 37, 39 and 41 the pattern with the compensator. In FIG. 6, the holes 43, 45, and 47 represent the M-16 without the compensator and the holes 49, 51 and 53 the impact pattern with the compensator. In both FIGS. 5 and 6 the angular dispersion was approximately 20 milliradians without the compensator and 3 milliradians with it.

While the invention is primarily intended for use on hand-held weapons, it can also be used with larger crew-served weapons. Also, the compensator can be arranged to be indexed by such an amount that the dispersion pattern will be expanded rather than contracted. Such a weapon would be used to spray rounds over a large area.

While the invention has been described in connection with illustrative embodiments, obvious variations therein are possible, accordingly the invention should be limited only by the scope of the appended claims.

I claim:

1. A burst fire compensator adapted to be rotatably attached to the barrel of a gun, comprising; a tubular collar adapted to fit over said barrel of said gun near the muzzle thereof, an asymmetric channel integrally attached to said collar, said asymmetric channel comprising an approximately half cylindrical projection forming an extension of approximately one half of said barrel, a plurality of lateral holes in said asymmetric channel running from the interior thereof to the outside thereof, said lateral holes being offset from alignment with the radial generators of said half cylindrical projection, means to adapt said compensator for rotation around said barrel after each round is fired, said means comprising said lateral holes and a spring-loaded ball mounted in a radial hole in said tubular collar, said ball engaging an annular groove in the perphery of said barrel, and detent means comprising one or more detent holes disposed along said groove adapted to be engaged by said spring-loaded ball.

2. The compensator of claim 1 wherein said barrel has three equally spaced detent holes around the periphery thereof and said compensator indexes through 120 degrees for each round fired.

3. The compensator of claim 1 wherein said barrel has eight equally spaced detent holes along said groove and said compensator is arranged to index 135 degrees per round fired.

4. A burst fire compensator comprising; a collar section adapted to fit snugly over the barrel of a weapon to be compensated, means to permit said collar to rotate around said barrel through a predetermined arc after the firing of each round of a burst, and an asymmetric channel forming an extension of a portion of said barrel attached to said collar section, said asymmetric channel comprising a plurality of lateral vent holes for producing a reaction torque resulting from propellant gases which vent through said holes, said torque automatically indexing said compensator through a predetermined arc after the firing of each round from said weapon.

5. The apparatus of claim 4 wherein said first-named means comprises detent means comprising a groove and one or more detent holes on the periphery of said barrel and a spring-loaded ball mounted in a radial hole in said collar section.

* * * * *